US009907720B2

(12) United States Patent
Kühne

(10) Patent No.: US 9,907,720 B2
(45) Date of Patent: Mar. 6, 2018

(54) DEVICE FOR THERAPY AND TRAINING FOR THE BACK

(71) Applicant: New Balls Training Concepts GmbH, Dorsten (DE)

(72) Inventor: Tetyana Kühne, Bochum (DE)

(73) Assignee: New Balls Training Concepts GmbH, Dorsten (DE)

( * ) Notice: Subject to any disclaimer, the term of this patent is extended or adjusted under 35 U.S.C. 154(b) by 0 days.

(21) Appl. No.: 14/916,788

(22) PCT Filed: Aug. 5, 2014

(86) PCT No.: PCT/DE2014/100322
§ 371 (c)(1),
(2) Date: May 30, 2016

(87) PCT Pub. No.: WO2015/032390
PCT Pub. Date: Mar. 12, 2015

(65) Prior Publication Data

US 2017/0007486 A1 Jan. 12, 2017

(30) Foreign Application Priority Data

Sep. 6, 2013 (DE) ..... 20 2013 104 026 U

(51) Int. Cl.
*A61H 15/00* (2006.01)
*A61H 1/00* (2006.01)
(Continued)

(52) U.S. Cl.
CPC ..... *A61H 1/008* (2013.01); *A61H 15/0092* (2013.01); *A63B 21/02* (2013.01);
(Continued)

(58) Field of Classification Search
CPC ..... A61H 1/008; A61H 15/0092; A61H 2015/005; A61H 2015/0057;
(Continued)

(56) References Cited

U.S. PATENT DOCUMENTS 681,331 A * 8/1901 Milkman ..... A61H 15/00 601/128
2,230,890 A * 2/1941 McClenathen ..... A61H 15/00 482/79

(Continued)

FOREIGN PATENT DOCUMENTS

DE 33 12 060 A1 10/1984
DE 296 03 435 U1 5/1996

(Continued)

*Primary Examiner* — Andrew S Lo
(74) *Attorney, Agent, or Firm* — Gudrun E. Huckett

(57) ABSTRACT

The invention relates to a device for therapy and training for the back, comprising two elastically deformable bodies (1) which are arranged at a distance from each other, between which a deformable spacer (2) which interconnects both bodies (1) is arranged, said device being characterized in that said spacer (2) is embodied as a spring element in form of a helical spring (2), the ends thereof being bent so as to form journals (2.1) extending in the extension of the helical spring axis, said journals being introduced into blocks (3) fixed in the inside of the bodies (1).

10 Claims, 1 Drawing Sheet

(51) Int. Cl.
*A63B 21/02* (2006.01)
*A63B 23/02* (2006.01)

(52) U.S. Cl.
CPC ..... *A63B 21/023* (2013.01); *A63B 23/0233* (2013.01); *A61H 2015/005* (2013.01); *A61H 2015/0057* (2013.01); *A61H 2201/1253* (2013.01); *A61H 2201/1623* (2013.01); *A61H 2205/081* (2013.01)

(58) Field of Classification Search
CPC .... A61H 2201/1253; A61H 2201/1623; A61H 2205/081; A61H 15/00; A63B 21/02; A63B 21/023; A63B 23/0233
USPC ..... 482/44–50, 121
See application file for complete search history.

(56) References Cited

U.S. PATENT DOCUMENTS 2,691,978 A 10/1954 Kirby
3,396,967 A * 8/1968 Brown ..... A63B 21/0455 482/128
4,210,135 A * 7/1980 Deuser ..... A61H 7/003 601/129
4,374,519 A * 2/1983 Stauft ..... A61H 15/00 482/132
4,643,417 A * 2/1987 Nieman ..... A63B 21/015 482/46
4,796,616 A * 1/1989 Panahpour ..... A61H 15/00 601/128
5,050,875 A * 9/1991 Lewkovich ..... A63B 21/05 482/128
5,481,771 A * 1/1996 Burk, IV ..... A47G 9/10 5/490
5,577,995 A * 11/1996 Walker ..... A61H 15/0092 601/118
5,577,996 A * 11/1996 Gardner ..... A61H 15/0092 601/118
5,580,336 A 12/1996 Coallier
5,772,563 A * 6/1998 Lin ..... A63B 23/0211 482/121
5,772,614 A * 6/1998 Lindquist ..... A63B 21/00061 601/116
5,788,617 A * 8/1998 Paris ..... A63B 21/00043 482/112
6,299,585 B1 * 10/2001 Yoo ..... A61H 7/001 601/118
6,398,694 B1 * 6/2002 Bountourakis ..... A63B 21/015 482/109
6,419,650 B1 * 7/2002 Ryan ..... A61H 15/00 601/122
9,027,184 B2 * 5/2015 Cohen ..... A47G 9/10 5/630
2005/0033205 A1 * 2/2005 Komkin ..... A61H 15/0092 601/131
2006/0229174 A1 * 10/2006 Bonutti ..... A63B 21/0004 482/111
2007/0015645 A1 * 1/2007 Hale ..... A63B 21/4015 482/140
2009/0093349 A1 * 4/2009 Cooper ..... A63B 21/0004 482/106
2010/0145243 A1 * 6/2010 Kantor ..... A61H 15/00 601/118
2010/0267523 A1 * 10/2010 Wilkinson ..... A63B 21/00069 482/45
2011/0105968 A1 * 5/2011 Angell ..... A61H 15/00 601/132
2011/0224056 A1 * 9/2011 Allen ..... A63B 21/0004 482/126
2011/0313333 A1 12/2011 Nicholson
2012/0077648 A1 3/2012 Farrow et al.
2013/0012358 A1 * 1/2013 Lynn ..... A63B 23/16 482/8
2013/0123078 A1 5/2013 Marji
2014/0228178 A1 * 8/2014 Brooks ..... A63B 23/16 482/44
2015/0360071 A1 * 12/2015 Lee ..... A63B 21/026 482/116

FOREIGN PATENT DOCUMENTS

DE 20 2012 104 883 U1 2/2013
JP H11-332955 A 12/1999

* cited by examiner

DEVICE FOR THERAPY AND TRAINING FOR THE BACK

BACKGROUND OF THE INVENTION

The invention relates to a device for therapy and training, comprising two elastically deformable bodies which are arranged at a distance from each other and between which a deformable spacer which interconnects the two bodies to each other is arranged.

A training device described in DE 33 12 060 A1 comprises two massage rolls which are supported to be displaceable along an axis and which are pre-tensioned outwardly or pressed outwardly by a spring arranged on the axis between the massage rolls. The axis is supported by a frame which restricts the outward movement of the massage rolls.

A therapy and training device described in DE 20 2012 104 883 U1 comprises two rotationally symmetrical, elastically deformable bodies which are connected with each other by an axis directly adjoining the two bodies and made of the material of these bodies and are housed in an envelope of flexible material. This envelope is provided in its middle region between the two bodies with a constriction having a smaller cross section than the cross section of the bodies. A spacer made also of flexible or elastically deformable material is placed around the constriction. This spacer ensures functionally similar to a joint that the two rotationally symmetrical bodies are flexibly moveable in the longitudinal direction as well as in the transverse direction appropriately for use.

US 2012/0077648 A1 describes an exercise device for the hand. This exercise device comprises two spherical weight members, preferably consisting of elastomeric material. These members are fastened to the ends of an elongate spring element on which a handle is situated centrally. After having gripped the handle, the weight members can be pivoted back and forth for exercising the hand and arm muscles. This known device is not suited for use as a therapy and training device for the back primarily due to the very large distance between the weight members and the handle.

U.S. Pat. No. 2,691,978 describes a massage device for the chin or chin region comprising two substantially spherical massage bodies which are fastened to an essentially bow-shaped, elastically deformable handle.

JP 000H11332955 A describes an exercising device with two spherical bodies connected to each other by an axis. A spring element is supported on the axis in order to push the two spherical bodies outwardly. This device is designed as an exercising device for the fingers.

U.S. Pat. No. 5,580,336 describes an exercising device to be used for exercising the hand. This device comprises two spherical bodies which are fastened to the ends of an axis. Each spherical body has a diameter of approximately 40 mm in order to be easily held in one hand. The length of the axis connecting the two spherical bodies with each other is designed such that the whole exercising device comprised of the two spherical bodies and the axis can fit into an open hand. The axis connecting the two spherical balls to each other has preferably a length of approximately 75 mm. The two spherical bodies consist of a soft elastic material. The axis is an elongate tube body on which the two spherical bodies can be shifted without being loaded by a spring. The axis is composed of two tube bodies which are provided with end stops and between which an intermediate member forming a joint is located.

It is an object of the invention to design a therapy and training device for the back such that, on the one hand, an appropriate training-related adaption of the device to the back of a person lying on the training device is ensured and that, on the other hand, the stability of the device is improved in particular compared to the back therapy device according to DE 20 2011 104 883 U1.

SUMMARY OF THE INVENTION

To solve this problem, the therapy and training device according to the invention, comprising two elastically deformable bodies which are arranged at a distance to each other and between which a deformable spacer connecting the two bodies to each other is mounted, is characterized in that the two elastically deformable bodies each form a separate unit and in that the spacer is embodied as a spring element.

According to a preferred embodiment the ends of the helical spring are bent so as to form pins positioned on an extension of the helical spring axis and introduced preferably into blocks fixed in the interior of the two bodies. The blocks preferable consist of metal, especially steel, or plastic material.

The blocks have a diameter of 27-33 mm, preferably 29-31 mm, and a height of 18-22 mm, preferably 19-21 mm.

According to a further preferred embodiment of the invention, on the outside surfaces of the two in particular rotationally symmetrical bodies elongated grooves are arranged which are extending substantially parallel to the helical spring axis.

BRIEF DESCRIPTION OF THE DRAWINGS

The invention will be described in the following with the aid of the drawing in more detail.

DESCRIPTION OF PREFERRED EMBODIMENTS

Figure 1:
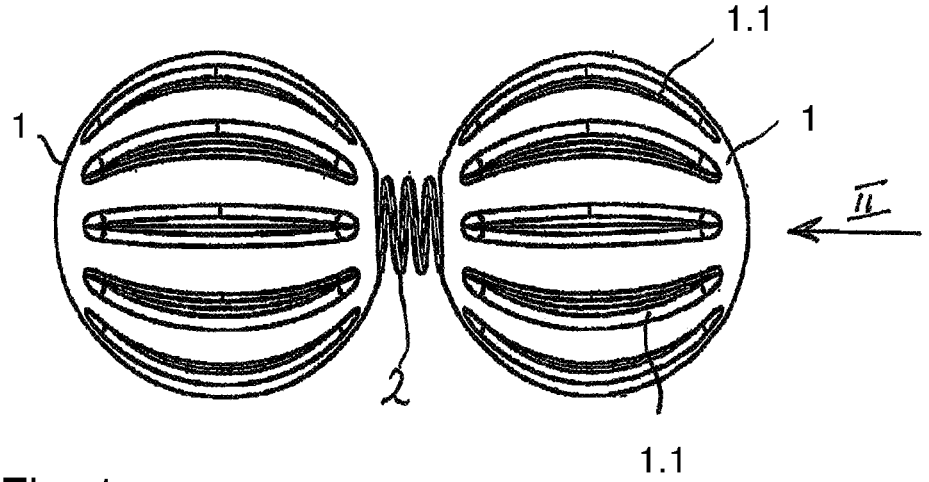
FIG. 1 shows a side view of the therapy and training device according to the invention.
Figure 2:
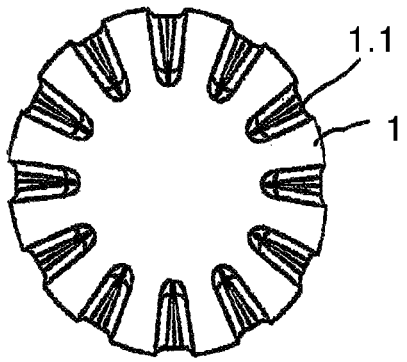
FIG. 2 shows a view in the direction of the arrow II in FIG. 1.
Figure 3:
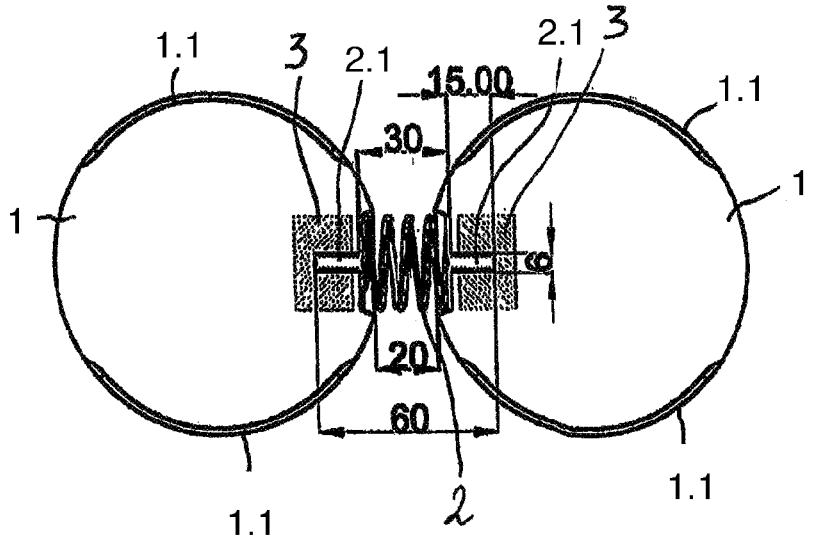
FIG. 3 shows a section view in a schematic representation.

The therapy or training device comprises two preferably rotationally symmetrical, especially spherical bodies 1 having a diameter between 50 mm and 140 mm and consisting especially of foamed material. Between the two bodies 1, a deformable spacer connecting the two bodies 1 with each other is arranged and is embodied as a spring element, preferably a helical spring 2. The ends of the helical spring 2 are bent to form pins 2.1 positioned on an extension of the helical spring axis and introduced or fastened into blocks 3 which are fixed in the interior of the bodies. The blocks 3 have preferably a diameter which is matched to the outer diameter of the helical spring 2 in a range of magnitude of 27-33 mm, preferably 29-31 mm, as well as a height of 18-22 mm, preferably 19-21 mm.

The bodies 1 have preferably such a hardness or stiffness that in use they deform by between 20% and 40% of their diameter.

The bodies 1 are provided at their outer surfaces with curved grooves or recesses 1.1 which are arranged parallel to the helical spring axis.

The blocks consists preferably of metal, especially steel, or of plastic material.

What is claimed is:

1. A therapy and training device for a back of a person, the device comprising:

two elastically deformable spherical bodies having a diameter between 50 mm and 140 mm;

a deformable spacer connecting the two spherical bodies to each other such that the two spherical bodies are spaced at a distance from each other, wherein the deformable spacer is a spring element;

the two spherical bodies having such a hardness or stiffness that, when loaded by the back of a person using the device, the two spherical bodies deform by between 20% and 40% of the diameter of the two spherical bodies;

wherein the spring element is a helical spring comprising opposed ends that are bent so as to form pins aligned with a helical spring axis of the helical spring and pointing away from each other.

2. The device according to claim 1, wherein the two spherical bodies each comprise a block arranged and fixed in an interior of the spherical bodies, respectively, wherein the pins are introduced into the blocks.

3. The device according to claim 2, wherein the blocks are comprised of metal.

4. The device according to claim 3, wherein the metal is steel.

5. The device according to claim 2, wherein the blocks are comprised of plastic material.

6. The device according to claim 2, wherein the blocks have a diameter of 27 mm-33 mm and a height of 18 mm-22 mm.

7. The device according to claim 6, wherein the blocks have a diameter of 29 mm-31 mm and a height of 19 mm-21 mm.

8. The device according to claim 1, wherein the spherical bodies comprise outer surfaces that are provided with curved grooves or recesses, wherein the curved grooves or recesses extend parallel to the helical spring axis of the helical spring.

9. The device according to claim 1, wherein the spherical bodies are comprised of foamed material.

10. The device according to claim 1, wherein the distance between the spherical bodies is 20 mm.

* * * * *